United States Patent [19]

Söderström

[11] 4,389,138

[45] Jun. 21, 1983

[54] DRAIN PIPE

[76] Inventor: Gert W. Söderström, 62 Hammarbyvägen, Uplands Väsby S.194-00, Sweden

[21] Appl. No.: 199,725

[22] PCT Filed: Dec. 3, 1979

[86] PCT No.: PCT/SE79/00245

§ 371 Date: Jul. 25, 1980

§ 102(e) Date: Jul. 25, 1980

[87] PCT Pub. No.: WO80/01180

PCT Pub. Date: Jun. 12, 1980

[30] Foreign Application Priority Data

Dec. 4, 1978 [SE] Sweden ..... 7812472
Jul. 16, 1979 [SE] Sweden ..... 7906140

[51] Int. Cl.[3] ..... E02B 13/00

[52] U.S. Cl. ..... 405/43; 405/36; 405/48; 138/111; 138/177

[58] Field of Search ..... 405/43, 45, 47, 48, 405/49, 44, 50, 46, 37–42; 138/111–115, 178, 177

[56] References Cited

U.S. PATENT DOCUMENTS

| | | | |
|---|---|---|---|
| 780,189 | 1/1905 | Jaekel | 405/48 |
| 1,052,226 | 2/1913 | Douglas | 405/48 |
| 1,078,637 | 11/1913 | Naylor | 405/43 |
| 1,350,229 | 8/1920 | Lee | 405/48 |
| 1,608,889 | 11/1926 | Lampe | 405/48 |
| 3,080,124 | 5/1963 | Rathman | 405/48 X |
| 3,369,367 | 2/1968 | Saad et al. . | |
| 3,416,321 | 12/1968 | Saad et al. . | |
| 4,016,727 | 4/1977 | Osaka et al. . | |
| 4,140,421 | 2/1979 | Lloyd | 405/43 |

FOREIGN PATENT DOCUMENTS 37805 12/1970 Finland .

*Primary Examiner*—Dennis L. Taylor
*Attorney, Agent, or Firm*—Burns, Doane, Swecker & Mathis

[57] ABSTRACT

A drain pipe consisting of an outer pipe casing, which downwardly or on the lower surface is provided in the longitudinal direction with a recess, from which two partition walls extend upward and are connected at the upper end to the inside of the pipe casing via extensions of the partition walls resembling inclined roofs. In the inclined roof shaped extensions, which are connected in a line at the inside of the pipe casing, overflow openings are milled in a single operation.

6 Claims, 4 Drawing Figures

DRAIN PIPE

BACKGROUND AND SUMMARY OF THE INVENTION

At buildings and at many other occasions it is desirable and necessary to drain off rainwater, in order to prevent damages and settlings by moisture. A problem heretofore unsolved in conventional drain pipes is, that the pipes after some time of use almost always clog with mud and must be dug out for exchange or cleaning, which involves large expenses. The problem arises in the earthenware pipes known since long ago as well as in the plastic pipes, which are provided with holes or slits and applied to an increasing extent though the plastic pipes are of such doubtful reliability, that they are banned by some local authorities.

The present invention, therefore, has the object to produce a drain pipe, which ensures efficient draining for a very long time without getting clogged by mud, and which at the same time is easy to manufacture and mount.

For achieving this object, the pipe according to the invention comprises an outer pipe, which is slitted on its lower surface. From the edges on both sides of the slit longitudinal walls are fixed. Holes or openings provided at the upper edges of the walls establish connection between the space located between the walls and the two spaces between the walls and the pipe proper. Drain water arising through the slit in the pipe between the inner walls can through this structure flow over into the two lateral channels of the drain pipe. The likelihood of clogging by mud is hereby reduced substantially, because, firstly, the water always must move upward before entering into the drain pipe. Since the mud suspended in the water is somewhat heavier than the water, the water is cleaned while arising between the walls. Secondly, the water cleaning effect is amplified by the very large drain surface, which the drain pipe provides in the form of the intermediate space between the walls, and which results in a low speed of water inflow into the drain pipe.

When the water has entered into the two drain channels on both sides of the partition walls, the drain water flows at a good speed, due to the relatively moderate flow cross-section. Said good speed ensures that mud possibly following along in these channels rapidly is transported away. This effect is improved additionally at a further development of the invention subject matter, according to which the holes or openings from the riser space for the drain water between the partition walls and into the two drain-off channels are located at different heights, so that at moderate water supply all this water is removed through the drain-off channel on one side. When this level has been exceeded, also the other channel is taken into use. Due to the generally moderate amounts of drain water, almost always only the drain-off channel, in which the openings are located at a low level, will be utilized. When this channel, for example due to unfavourable external conditions, gradually is clogged by mud, the other channel remains to be used, and the life of the drain pipe, thus, is extended substantially. In order to facilitate the manufacture of the invention subject matter, the two partition walls drawn up from the slit at the bottom of the pipe preferably are interconnected at their upper edges and/or are connected to the inner wall of the pipe with an inclined roof extending inward to each other, so that in these parts of the walls holes can be drilled or openings can be milled easily by a drill or milling cutter respectively inserted through the slit. It is hereby possible to manufacture the drain pipe by extrusion and subsequent milling operation, and the pipe, in spite of its qualified function, is not more complicated to manufacture than other known plastic drain pipes. Due to the connection of the partition walls with the inside of the pipe, besides, the resistance of the pipe in the normally vertical strain direction is increased.

In order to prevent the drain pipe from being compressed at the lower surface by the soil pressure, preferably supports for the pipe are provided, which supports, like claws embrace the pipe and maintain it in the position with the slit located downwardly, and which supports finally engage with the slit by a small plug or boss so that the slit cannot be pressed together.

In order to prevent water transport in the longitudinal direction of the pipe in the riser space for the water between the partition walls, additional walls in the form of plugs or the like are inserted equally spaced into this space. These walls can be provided, for example, at every pipe joint, if the pipe is not manufactured endless. In endless pipes it may be sufficient to provide plugs which are assembled with the aforesaid supports for the pipe.

One objection apparently obvious to be raised against the invention subject matter as to its function is, that the water would not flow into the two drain-off channels due to the rising height required for the drain water before it flows over into the drain off channels, and that the drain pipe, moreover, has no drain holes on the upper surface and, thus, would have a drain effect worse than that of conventional structures.

This argument though logical is wrong. It is not necessary for a drain pipe, as a matter of fact, to itself have the same level as the intended drain level. The conventional structures, however, prove that the designer of drain pipes heretofore has not succeeded to disengage from this wrong idea. The drain level of the invention subject matter, thus, is determined by the lower edge of the openings in the respective partition walls while the drain-off level is located below this level. It is, consequently, necessary to place the drain pipe according to the invention at a slightly greater depth than the conventional drain pipes. This greater depth, however, is smaller than the diameter of the pipe, and the insignificant increase in costs caused by the slightly greater laying depth of the drain pipe is more than compensated for by its higher efficiency and above all by its higher reliability compared with known structures.

The partition walls drawn high up in the pipe yield a further advantage of the invention subject matter over the prior art. It is thereby possible, namely, to drain off also rainwater from gutters and down pipes into drain-off channels of the drain pipe. This double utilization of the drain pipe brings about a more efficient flushing of the pipe, thereby additionally reducing the risk of clogging. At the same time the costs of a drain-off piping for the down pipe water can be saved. Besides, in this way an immediate indication is obtained when a drain pipe is clogged by mud, because then the associated down pipe will overflow. In many cases it also will be possible via the down pipe to clean one of the drain-off channels of the drain pipe so that its function can be restored. The dimensions of the drain pipe, of course, must be adapted to the calculated amount of drained-off water together with the water amount from down pipes, but the total cost for the pipe yet is lower than for two pipes having the same total capacity.

BRIEF DESCRIPTION OF THE DRAWINGS

The invention is described in greater detail in the following by way of an embodiment thereof, and with reference to the accompanying drawings, in which.

DETAILED DESCRIPTION OF THE PREFERRED EMBODIMENT

Figure 1:
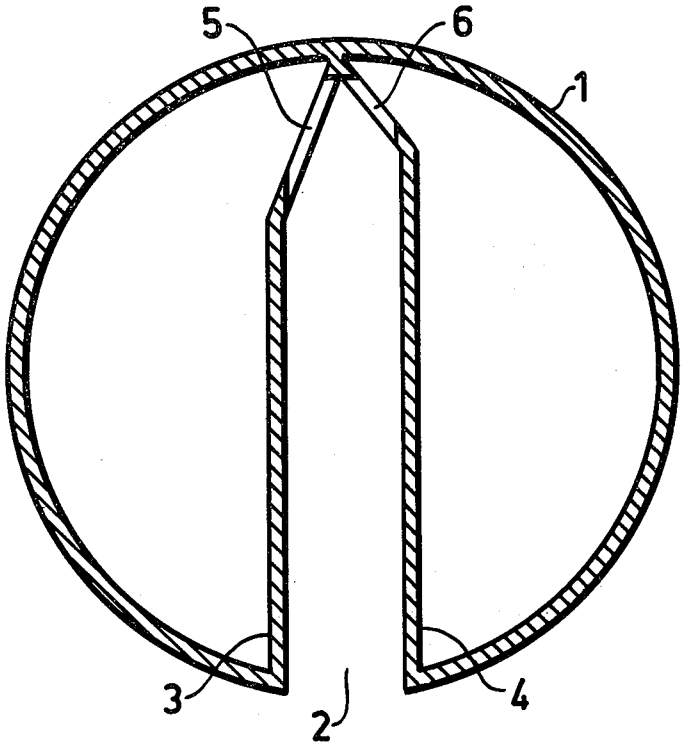

The drain pipe shown in FIG. 1 comprises an outer pipe casing 1, which at its lower edge is slitted or provided with a recess 2, from the edge of which partition walls 3 and 4, respectively, extend upward to the upper surface of the pipe casing 1. The partition walls 3 and 4 are at their upper edges attached to the inner wall of the pipe casing 1 by extensions resembling inclined roofs. Said inclined roof portions are designated by 5 and 6, respectively, and extend toward each other to be interconnected at the attachment point to the pipe casing 1. In the embodiment shown in FIG. 1, the left-hand inclined roof portion 5 has a steeper inclination than the right-hand portion 6. Hereby different levels for the openings have been obtained which are milled in the inclined roof portions 5 and 6 by means of a milling cutter operating centrally in the slit 2, so that the desired different inlet levels to the drain-off channels described above between the partition walls 3 and 4 and, respectively, the interior of the pipe casing 1 are obtained.

Figure 2:
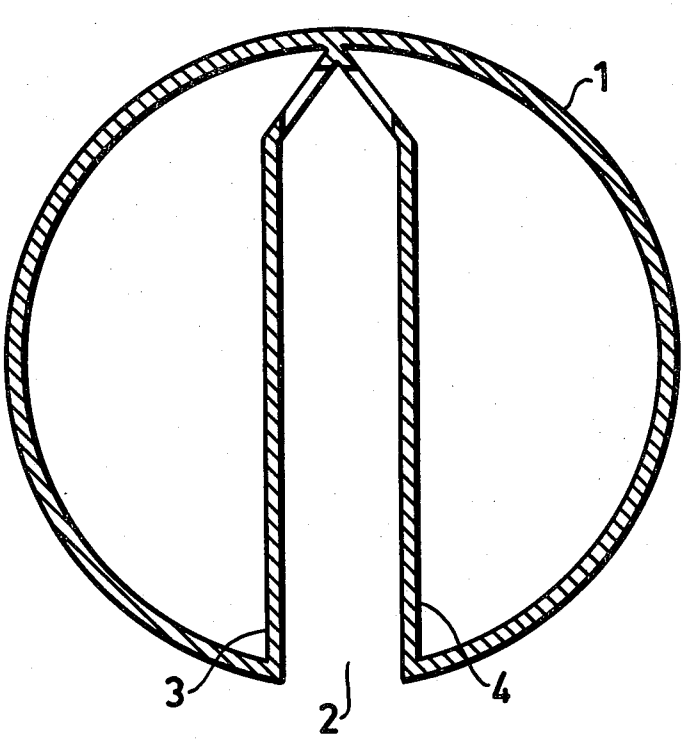
FIGS. 1 and 2 are cross-sections through different embodiments of a drain pipe according to the invention.

With reference to FIG. 2, a drain pipe, which substantially agrees with the one shown in FIG. 1, with the exception that the inclined roof portions connecting the partition walls 3 and 4 with the pipe casing 1 have the same inclination, has the same level for both openings in the roof portions 5, 6.

Figure 3:
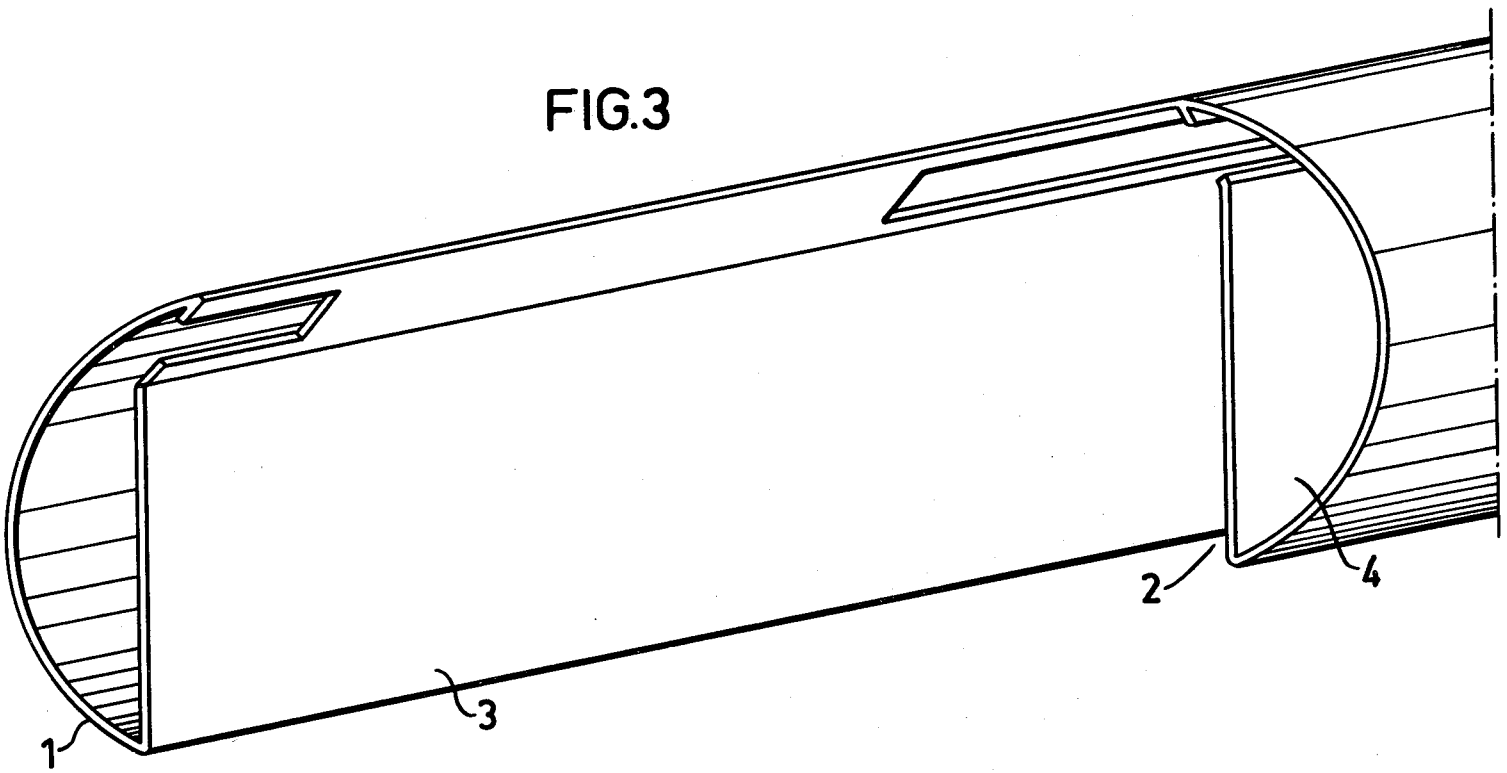
FIG. 3 is a perspective view of the drain pipe shown in FIG. 2, one side partially cut away.

In FIG. 3 is shown more clearly the appearance especially of the openings in the inclined roof extensions on the partition walls 3 and 4.

Figure 4:
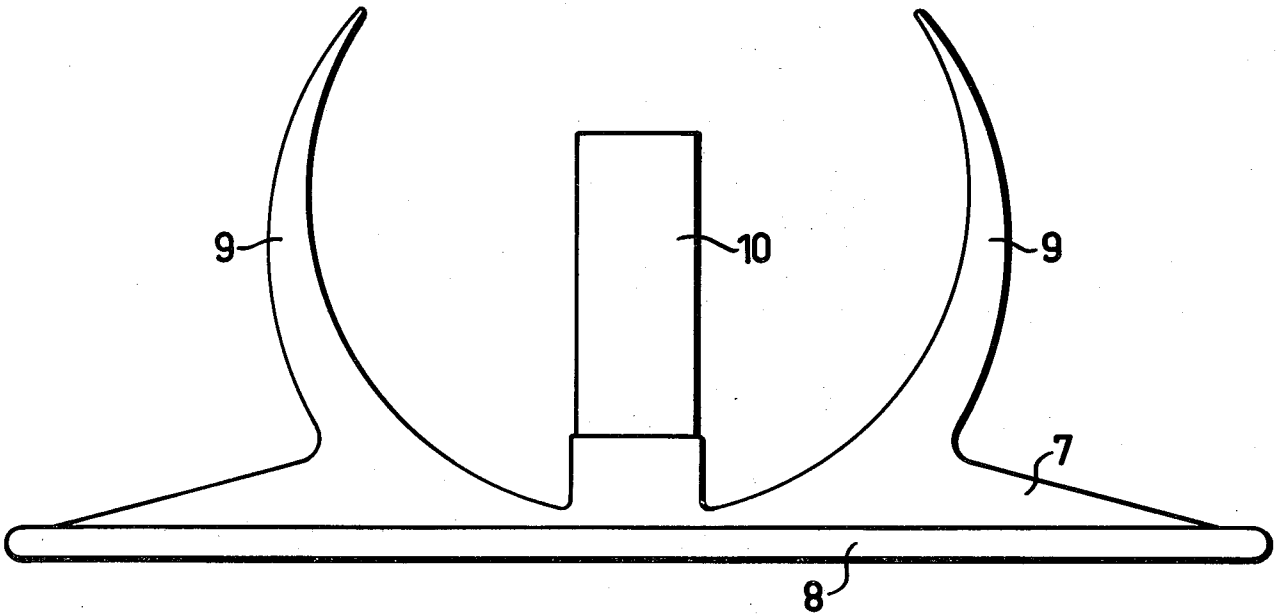
FIG. 4 is a cross-sectional view of a mounting support for the drain pipe.

With reference to FIG. 4*a* pipe support 7 comprises a bottom plate 8 and two claws or arms 9 for embracing the pipe. Said pipe support has as its function both during mounting and during operation to maintain the drain pipe so that its slit faces downward. The support further includes between the two arms 9 a plug or partition wall portion 10, which has two objects. It firstly prevents the drain pipe from being compressed by the soil pressure and, secondly, it prevents water movements in the longitudinal direction of the pipe which may result in mud collection at one end of the pipe.

For connecting the drain pipe to surface water wells or to conduits to such wells, preferably a plug is provided in the pipe which closes the space between the partition walls, but which leaves the drain-off channels for the water substantially free. By designing the plug so as to complete the circumference of the pipe casing at the slit, an entirely circular pipe outer surface is obtained which can be jointed in known manner, for example in a sleeve.

The principles and preferred embodiment of the present invention have been described in the foregoing specification. However, the invention which is intended to be protected is not to be construed as limited to the particular embodiment disclosed. The embodiment is to be regarded as illustrative rather than restrictive. Variations and changes may be made by others without departing from the spirit of the present invention. Accordingly, it is expressly intended that all such variations and changes which fall within the spirit and scope of the present invention as defined in the appended claims be embraced thereby.

What is claimed is:

1. A drain pipe, comprising an outer pipe casing, at least one longitudinal opening in a lower surface of the pipe casing, a wall extending upwardly from each longitudinal edge of the at least one opening to form between the walls a water riser space for drain water, a plurality of openings at an upper edge of each of the walls, the walls being connected to an upper inside surface of the pipe casing whereby water can flow into channels formed between the walls and the pipe casing.

2. A drain pipe as defined in claim 1, wherein the pipe casing comprises a longitudinal section with the at least one opening extending over the entire pipe casing length, the walls extending upwardly from the opening are terminated near an upper edge by portions resembling inclined roofs, said portions extending toward each other and being attached at the upper edge to the upper inside surface of the pipe casing, said inclined roof portions being provided with the plurality of openings for the water.

3. A drain pipe as defined in claim 2, wherein the walls are parallel, and the two portions resembling inclined roofs and terminating the walls have different angles in relation to the walls.

4. The drain pipe of claim 2 wherein the openings in both walls are formed in a single operation.

5. The drain pipe of claim 2 or 3 wherein the openings in one wall extend further downwardly toward the longitudinal opening than the openings in the other wall.

6. The drain pipe of claim 1 further comprising a support having two arms for supportively surrounding the casing, said support including barrier means both for maintaining the walls spaced from one another and for preventing longitudinal movement of water between the walls.

* * * * *